US011548762B2

(12) United States Patent
Haapaniemi et al.

(10) Patent No.: US 11,548,762 B2
(45) Date of Patent: Jan. 10, 2023

(54) ELEVATOR CAR, ELEVATOR AND METHOD

(71) Applicant: KONE Corporation, Helsinki (FI)

(72) Inventors: Markku Haapaniemi, Helsinki (FI); Matti Räsänen, Helsinki (FI); Anssi Venho, Helsinki (FI); Sakari Korvenranta, Helsinki (FI)

(73) Assignee: KONE CORPORATION, Helsinki (FI)

( * ) Notice: Subject to any disclaimer, the term of this patent is extended or adjusted under 35 U.S.C. 154(b) by 0 days.

(21) Appl. No.: 17/237,947

(22) Filed: Apr. 22, 2021

(65) Prior Publication Data

US 2021/0354955 A1 Nov. 18, 2021

(30) Foreign Application Priority Data

May 12, 2020 (EP) ..... 20174198

(51) Int. Cl.
*B66B 5/00* (2006.01)

(52) U.S. Cl.
CPC ..... *B66B 5/0081* (2013.01); *B66B 5/0087* (2013.01)

(58) Field of Classification Search
CPC ..... B66B 5/0081; B66B 5/0087; B66B 5/005; B66B 11/0246
See application file for complete search history.

(56) References Cited

U.S. PATENT DOCUMENTS 6,419,052 B1 * 7/2002 Muller ..... B66B 11/0246 187/414
6,880,678 B1 * 4/2005 Schneider ..... B66B 11/0246 187/314
2006/0289244 A1 * 12/2006 Sittier ..... B66B 11/0246 187/401
2007/0056810 A1 * 3/2007 Fernandes ..... B66B 11/0246 187/401
2012/0085032 A1 * 4/2012 Heikintupa ..... B66B 11/0226 49/506

(Continued)

FOREIGN PATENT DOCUMENTS

CN 106904515 A 6/2017
EP 3 484 808 A1 5/2019

(Continued)

OTHER PUBLICATIONS

JPH06278973A—Machine translation (Year: 1993).*
Extended European Search Report issued in Application No. 20174198.0 dated Nov. 13, 2020.

*Primary Examiner* — Michael A Riegelman
(74) *Attorney, Agent, or Firm* — Birch, Stewart, Kolasch & Birch, LLP

(57) ABSTRACT

An elevator car includes a roof deck; a plurality of walls; a floor; one or more doors; and a transport space bordered by the roof deck, the plurality of walls, the floor, and at least one openable and closable door for allowing access to said transport space. The roof deck is vertically movable from a first normal use position upwards to a second cargo use position for increasing the height of the transport space, and from the second position downwards back to the first position for reducing the height of the transport space. An elevator and a method implementing the elevator car are also disclosed.

20 Claims, 9 Drawing Sheets

(56) References Cited

U.S. PATENT DOCUMENTS

| | | | | |
|---|---|---|---|---|
| 2012/0279805 | A1* | 11/2012 | Meyer | F03D 80/50 187/254 |
| 2013/0098713 | A1* | 4/2013 | Urben | B66B 11/0226 187/401 |
| 2016/0325965 | A1* | 11/2016 | Haapaniemi | B66B 5/0062 |
| 2019/0112158 | A1* | 4/2019 | Haapaniemi | B66B 5/005 |
| 2019/0119072 | A1* | 4/2019 | Haapaniemi | B66B 11/0246 |
| 2019/0119073 | A1* | 4/2019 | Haapaniemi | B66B 11/0246 |
| 2019/0119074 | A1* | 4/2019 | Haapaniemi | B66B 5/005 |
| 2019/0135586 | A1* | 5/2019 | Haapaniemi | B66B 1/3415 |
| 2019/0263629 | A1* | 8/2019 | Fernandez | B66B 11/0246 |
| 2019/0308848 | A1* | 10/2019 | Litteral | B66B 5/0056 |
| 2019/0330023 | A1* | 10/2019 | Fauconnet | B66B 11/0206 |
| 2021/0238009 | A1* | 8/2021 | Xiong | B66B 11/0226 |
| 2021/0269279 | A1* | 9/2021 | Talonen | B66B 1/30 |
| 2021/0269283 | A1* | 9/2021 | Siironen | B66B 11/0246 |
| 2021/0354955 | A1* | 11/2021 | Haapaniemi | B66B 5/0081 |

FOREIGN PATENT DOCUMENTS

| | | | |
|---|---|---|---|
| JP | 6-278973 | A | 10/1994 |
| JP | 2007-1698 | A | 1/2007 |
| WO | WO 2018/011463 | A1 | 1/2018 |

* cited by examiner

ELEVATOR CAR, ELEVATOR AND METHOD

FIELD OF THE INVENTION

The invention relates to an elevator car, an elevator and a method for transporting passengers and goods.

BACKGROUND OF THE INVENTION

During construction of a building, people and goods need to move vertically for enabling construction work in the upper parts of the building under construction. For example, construction workers need to move to the floor where their construction site is located, as well as away from that floor. Likewise, goods, such as tools, equipment and construction material need to move to the floor where the construction site of the respective tools, equipment and construction material is located. Also, people not participating in the construction work may need to move between floors.

In prior art, transportation of large construction material has been performed by lifting with a building crane and/or by temporary hoists and/or by a temporary elevator installed outside a building under construction. People have been transported by a car operating in a hoistway of the building.

A drawback of said known solutions for transporting goods and people has been that they have not been optimized in terms of efficiency of flow of both people and goods.

BRIEF DESCRIPTION OF THE INVENTION

The object of the invention is to introduce a new elevator car, a new elevator and a new method, which facilitate safe, convenient and efficient flow of both people and goods to be transported in a building.

An object is to introduce a solution by which one or more of the above defined problems of prior art and/or problems discussed or implied elsewhere in the description can be solved.

An object is further to introduce a solution which provides safe, convenient and efficient flow of both people and large-sized goods such as construction material of a construction-time building, for instance. When the building is a building under construction, said objects are achieved while at the same time facilitating simple and quick transition to serving transportation needs of the final building, which may be different from those of the building during construction-time thereof.

It is brought forward a new elevator car comprising a roof deck; plurality of walls; a floor; one or more doors; and a transport space bordered by said roof deck, said plurality of walls, said floor, and said one or more doors. The roof deck is vertically movable from a first "normal use" position I upwards to a second "cargo use" position II for increasing the height of the transport space, and from said second position II downwards back to said first position I, in particular for reducing the height of the transport space. With this solution one or more of the above mentioned objects can be achieved.

Particularly, this provides that the elevator car can be swiftly and efficiently temporarily shifted to a state where it can receive larger goods than normally. Thus, the elevator car can be used for transporting passengers, efficiently, conveniently and safely while the rood deck is in its normal use position, and large goods while the rood deck is in the cargo use position. The movable structure being roof deck provides that it is relatively quick to move between positions.

Preferable further details are introduced in the following, which further details can be combined with the elevator car individually or in any combination.

In a preferred embodiment, the elevator car comprises a displaceably mounted panel below the roof deck, in particular covering the lower face of the roof deck. The cover panel may be a decorative panel or a panel carrying a light source, for example. The cover panel provides that the roof deck can be robust and it need not be visible nor aesthetic nor optimized with regard to positioning of a possible light source. Thus, it is also possible to protect surfaces of the car during transportation of exceptionally large goods.

In a preferred embodiment, the roof deck forms a working platform on top of which a person can stand outside the elevator car, in particular when the roof deck is in said first position.

In a preferred embodiment, the elevator car preferably comprises railings mounted on top of the car, in particular railings between which a person can stand outside the car.

In a preferred embodiment, the roof deck is vertically movable within a space between the railings.

In a preferred embodiment, the railings surround the vertical projection of the roof deck.

In a preferred embodiment, the railings walls surrounding laterally a working space.

In a preferred embodiment, the railings comprise one or more portions pivotal between a vertical orientation and an inclined orientation. The inclined orientation may be horizontal, for example.

In a preferred embodiment, when the roof deck is in said first position the vertical distance D1 between the upper face of the floor and the lower face of the roof deck is more than 1.8 meters, and when the roof deck is in said second position the vertical distance D2 between the upper face of the floor and the lower face of the roof deck is a distance Dd longer, which distance Dd is preferably at least 30 cm, than when the roof deck is in said first position. The distance D1 being more than 1.8 meters provides that passengers fit below the roof deck when it is in normal use position. Said distance Dd is preferably at least 30 cm, however more preferably at least 50 cm, and more preferably at least 1 meter. Said distance Dd is in general preferably less than 2 meters.

In a preferred embodiment, said first position is the lowermost extreme position, and said second position is the uppermost extreme position, and the roof deck is movable only between said extreme positions, in particular blocked from moving below said first position and blocked from moving above said second position.

In a preferred embodiment, when the roof deck is in said second position the distance D2 between the upper face of the floor and the lower face of the roof deck is more than 2.5 meters.

In a preferred embodiment, when the roof deck is in said second position the distance D2 between the upper face of the floor and the lower face of the roof deck less than 5 meters.

In a preferred embodiment, the roof deck is horizontal in said second position II. Preferably, when the roof deck is horizontal, a planar upper face of the roof deck is horizontal. Said planar upper face f of the roof deck which is horizontal preferably forms the upper face of a working platform on top of which a person can stand outside the elevator car, in particular when the roof deck is in said first position I. The area of horizontal upper face f of the roof deck is preferably at least 0.5 m2, preferably more, such as at least 1 m2.

In a preferred embodiment, the elevator car comprises a locking equipment operable to lock the roof deck immovably in said second position II and/or said first position I.

In a preferred embodiment, the locking equipment comprises a locking rod movably mounted on the roof deck and movable to and from a recess or recesses which is/are immovable at least in vertical direction.

In a preferred embodiment, the elevator car comprises one or more vertically extendable support mechanism by which the roof deck is mounted stationary structures of the car in particular relative to which the roof deck is movable, the stationary structures preferably being the car frame or car wall, for instance. Preferably, the elevator car comprises plurality of said extendable support mechanisms. The plurality of said extendable support mechanisms are arranged at horizontally displaced locations for facilitating stability of the roof deck particularly in its second position II.

In a preferred embodiment, each said vertically extendable support mechanism comprises one or more pivotal arms.

In a preferred embodiment, the roof deck is in the same horizontal attitude in each said position I and II.

In a preferred embodiment, the roof deck comprises a portion displaceable for forming an opening in the roof deck.

In a preferred embodiment, the elevator car comprises at least one actuating arrangement for moving the roof deck vertically from said first position I upwards to said second position II and/or from said second position II downwards to said first position I. Thus, the roof deck can be easily moved between positions. The actuating arrangement preferably comprises at least one actuator. The actuator is preferably an electric motor.

In a preferred embodiment, the actuating arrangement is a screw jack.

In a preferred embodiment, the roof deck is such large that the vertical projection thereof covers majority, i.e. more than 50%, of the vertical projection of the transport space, most preferably however more than 75% of the vertical projection of the transport space.

In a preferred embodiment, the door is openable and closable, preferably being a sliding door or a swing door, for example.

In a preferred embodiment, the door is an automatic door. The door is preferably automatically openable and closable by a door operator comprised in the car. An automatic door provides high degree of conveniency for passenger use, while also facilitating efficiency and safety of operation. Such high degree of conveniency and efficiency is thus present while the elevator car can transport large goods such as construction material, which is particularly advantageous during construction time of the building.

In a preferred embodiment, the elevator car comprises a diverting wheel arrangement for guiding a suspension roping, said diverting wheel arrangement being separate from the roof deck, preferably comprising diverting wheels for suspending the elevator car from below.

In a preferred embodiment, the aforementioned diverting wheels are mounted lower than the transport space and positioned to guide the suspension roping to pass below the floor across the vertical projection thereof.

In a preferred embodiment, the car comprises a detector, such as an electronic switch, arranged to detect the position of the roof deck. This facilitates safety of the elevator. With this solution one or more of the above mentioned objects can be achieved.

It is also brought forward a new elevator comprising a car as described above. Preferable further details are introduced in the following and above, which further details can be combined with the elevator individually or in any combination.

In a preferred embodiment, the elevator car is arranged to travel along at least one guide rail mounted in a hoistway.

In a preferred embodiment, the hoistway is inside a building.

In a preferred embodiment, the car comprises one or more detectors, such as electronic switches for instance, arranged to detect the position of the roof deck.

In a preferred embodiment, the elevator comprises an elevator control system configured to receive signals from one or more user interfaces and automatically move the car in response to said signals. Said user interfaces preferably comprise one or more user interfaces at one or more landings, a user interface inside the elevator car or mobile device comprising a user interface software communicating with the elevator control system.

In a preferred embodiment, the elevator control system is configured to control movement of the elevator car based on position of the roof deck detected by said one or more detectors.

In a preferred embodiment, the control system is configured to prevent at least part of functions of the elevator when one or more detectors indicate that the roof deck is away from its first position.

In a preferred embodiment, the prevented functions comprise automatically moving the car in response to signals from one or more user interfaces, which are at one or more landings. Thus, passenger are not normally served when the roof deck is in cargo position which facilitates safety of the elevator.

It is also brought forward a new method for transporting passengers and goods, comprising transporting passengers with the elevator car as described above and/or in any of the claims of the application while the roof deck is in said first position I; and thereafter moving the roof deck from said first position I to the second position II for thereby increasing the height of the transport space of the car; and thereafter transporting goods with the elevator car 1 while the roof deck is in said second position II.

With this solution one or more of the above mentioned objects can be achieved.

Preferable further details are introduced in the following and above, which further details can be combined with the method individually or in any combination.

In a preferred embodiment, in said transporting passengers, the passengers are in the transport space of the car in particular below the roof deck.

In a preferred embodiment, in said transporting goods, the goods is/are in the transport space of the car, in particular below the roof deck.

In a preferred embodiment, the method comprises after said transporting goods with the elevator car while the roof deck is in said second position II, moving the roof deck from said second position II back to the first position I.

In a preferred embodiment, the method comprises between said moving roof deck from said first position I to a second position II and subsequent transporting, locking the roof deck immovably in the second position II, in particular by operating a locking equipment.

In a preferred embodiment, each said transporting passengers with the elevator car comprises receiving by an elevator control system signals from one or more user interfaces and automatically moving the car in response to said signals. Said user interfaces preferably comprise one or more user interfaces at one or more landings, a user interface inside the elevator car or mobile device comprising a user interface software communicating with the elevator control system.

In a preferred embodiment, the method comprises detecting position of the roof deck with one or more detectors.

In a preferred embodiment, the method comprises controlling movement of the elevator car based on position of the roof deck detected by one or more detectors.

In a preferred embodiment, the method comprises, preventing, in particular by a control system, at least part of functions of the elevator when one or more detectors indicate that the roof deck is away from its first position.

In a preferred embodiment, the prevented functions comprise automatically moving the car in response to signals from one or more user interfaces, which are at one or more landings. Thus, passenger are not normally served when the roof deck is in cargo position II.

In a preferred embodiment, the building is under construction. It may be such that it has not reached its final height yet, the upper parts thereof still being missing. Hereby, preferably during the method, the building under construction is constructed to be higher, most preferably during the method new floors are constructed on existing floors of the building under construction.

In a preferred embodiment, said elevator hoistway is delimited by one or more inner walls of the building, said walls preferably being concrete walls.

BRIEF DESCRIPTION OF THE DRAWINGS

In the following, the present invention will be described in more detail by way of example and with reference to the attached drawings, in which.

The foregoing aspects, features and advantages of the invention will be apparent from the drawings and the detailed description related thereto.

DETAILED DESCRIPTION

Figure 1:
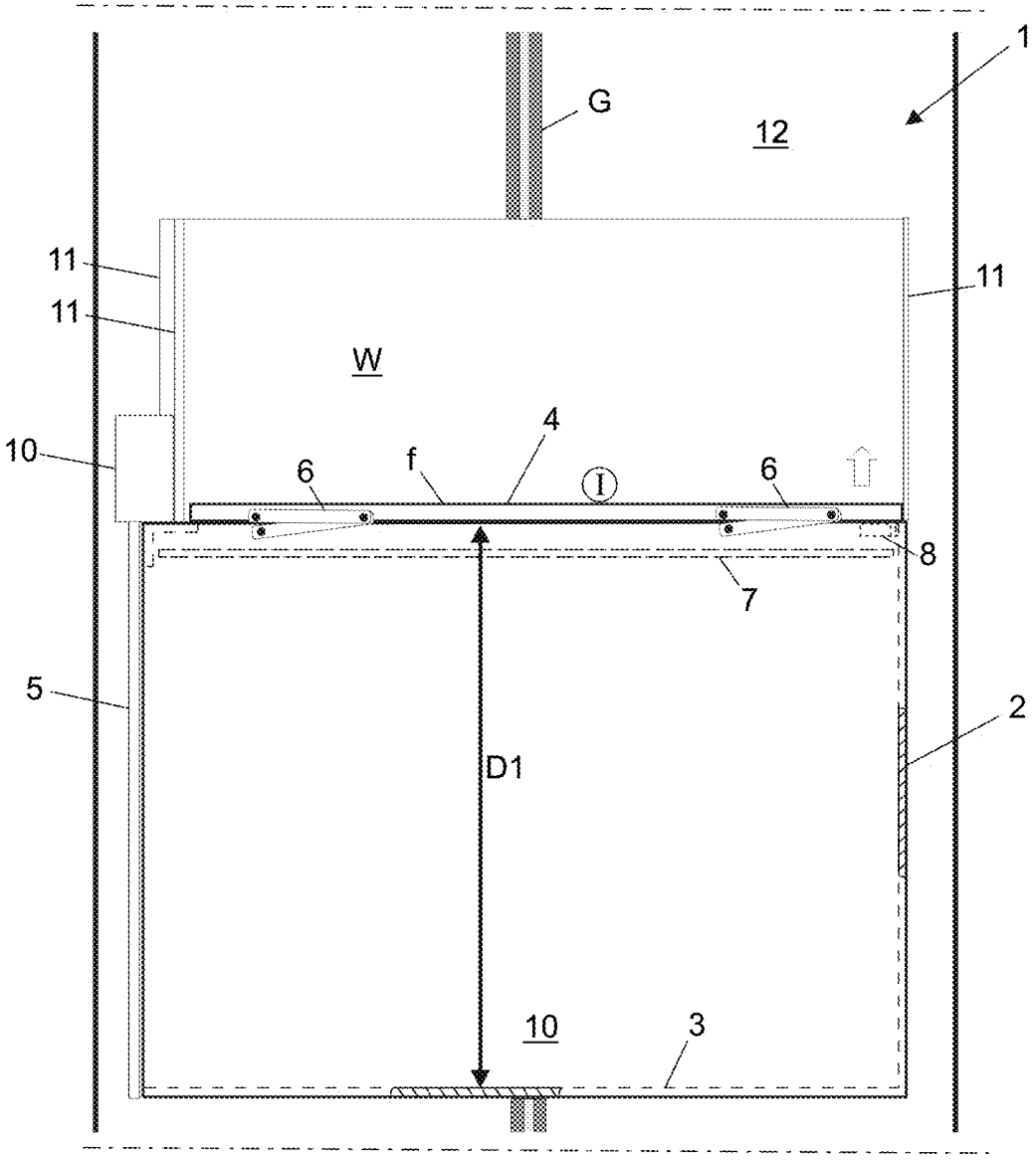
FIG. 1 illustrates an elevator car according to an embodiment in its first position as viewed from a side.

FIG. 1 illustrates an embodiment of an elevator car 1 comprising a roof deck 4 plurality of walls 2, a floor 3, and at least one door 5.

The elevator car comprises a transport space 10 bordered by said roof deck 4 plurality of walls 2, a floor 3, and at least one door 5.

The roof deck 4 is vertically movable from a first "normal use" position I upwards to a second "cargo use" position II for increasing the height of the transport space 10, and from said second position II downwards back to said first position I, in particular for reducing the height of the transport space 10. The elevator car can be designed such that the first position I is safe and convenient whereas the cargo position need not fulfil all the same requirements. For example noise level and esthetic appearance can be better in the normal use when the roof deck 4 is in the first position I. These are not generally highly important in cargo transport use, which may be utilized e.g. only exceptionally and/or temporarily. Accordingly, possibility to return the roof deck 4 back to its first position I after need for large cargo transportation has ceased is advantageous.

Figure 2:
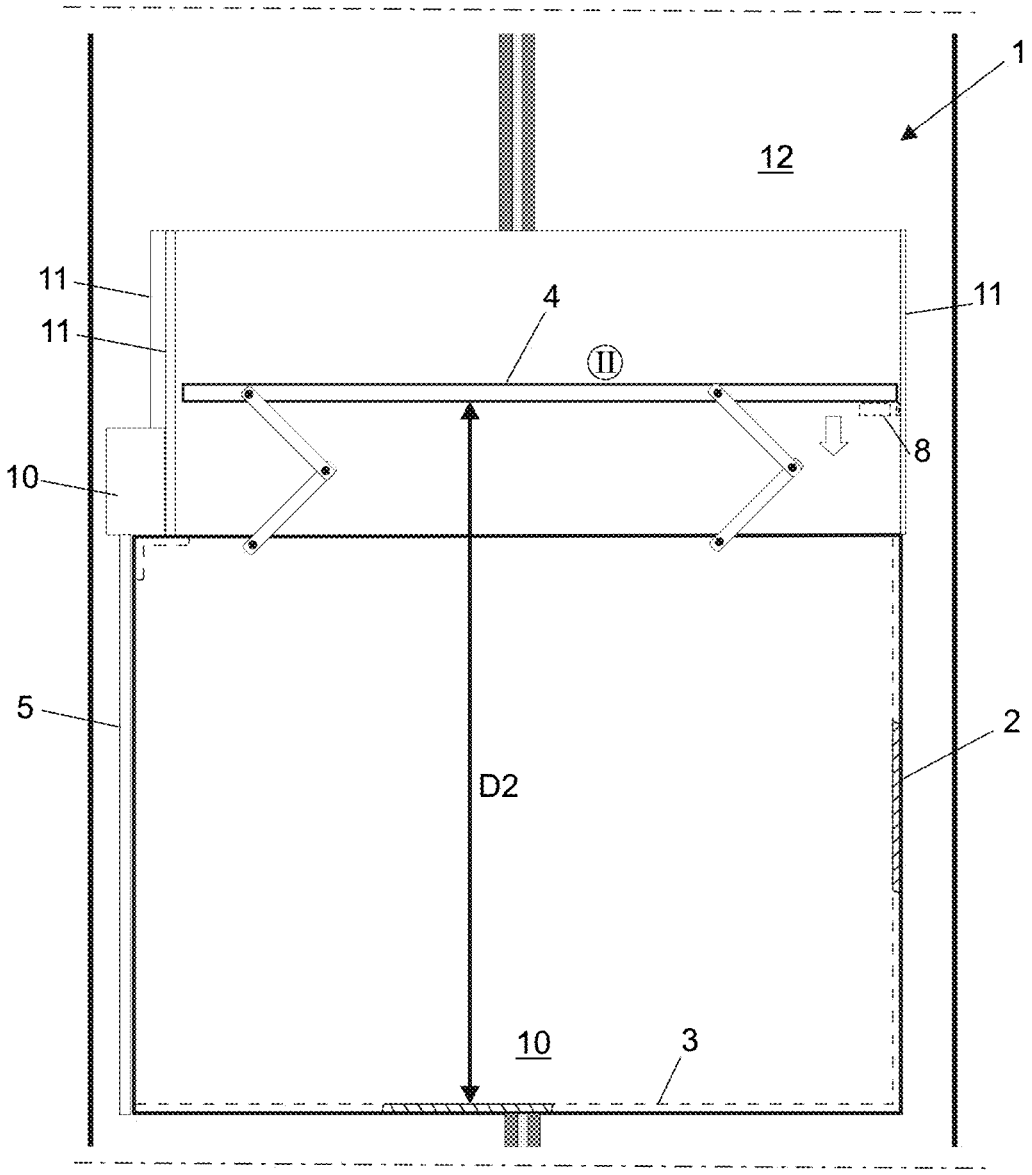
FIG. 2 illustrates the elevator car of FIG. 1 in its second position as viewed from a side.

FIG. 1 illustrates the elevator car 1 when the roof deck 4 is in its first position I and FIG. 2 illustrates the elevator car 1 when the roof deck 4 is in its second position II. When the roof deck 4 is in said first position the vertical distance D1 between the upper face of the floor and the lower face of the roof deck 4 is more than 1.8 meters, and when the roof deck 4 is in said second position the vertical distance D2 between the upper face of the floor and the lower face of the roof deck 4 is a distance Dd longer, which distance Dd is preferably at least 30 cm, than when the roof deck 4 is in said first position. Providing only a very short distance would not provide substantial benefits. For this reason, said distance Dd is preferably at least 30 cm, but preferably more. Said distance Dd is more preferably at least 50 cm, more preferably at least 1 meter. Said distance Dd is preferably, however, less than 2 meters. It is likely that transportation of extremely high objects is rarely needed and since a very long vertical extension of the transport space 10 is difficult to simply and economically arrange, enlargement of the transport space by more than 2 meters is likely not needed, although this is of course possible.

The elevator car 1 may comprise a displaceably mounted cover panel 7, which may be in particular a decorative panel and/or a panel carrying a light source, below the roof deck 4, in particular covering the lower face of the roof deck 4. A cover panel 7 is not necessary. However, it is advantageous since then the roof deck 4 can be robust and it need not be always visible nor aesthetic nor optimized with regard to positioning of the light source. Thus, it is also possible to displace these aesthetic surfaces and/or the lights of the car for the time of transportation of exceptionally large goods whereby they will not be harmed during said transportation. The cover panel 7 is illustrated in broken line in FIG. 1. The cover plate 7 may be mounted by releasable fixing means, such as by screws or by a quick release mechanism. The cover panel 7 can be for example removed from the car 1 for the time the roof deck is in said second position II. In FIG. 2, the cover plate 7 has been displaced and from its position.

Preferably, the roof deck 4 forms a working platform on top of which a person can stand when the roof deck 4 is in said first position I, in particular when the person is outside the car 1, e.g. performing maintenance work in the hoistway H.

Preferably, the roof deck 4 has a limited range of movement within which the roof deck 4 is movable and the roof deck 4 is permanently blocked from moving outside said range, in particular above an uppermost extreme position and below a lowermost extreme position. Said first position I is the lowermost extreme position of the roof deck 4, and said second position is the uppermost extreme position of the roof deck 4, and the roof deck 4 is movable only between said extreme positions, in particular blocked from moving below said first position and blocked from moving above said second position.

For achieving a considerable volumetric enlargement while at the same time keeping the vertical dimensions of the car 1 minimal, e.g. for improving safety and ability to travel close to the ceiling of the hoistway, the roof deck 4 is horizontal in said second position II. Correspondingly, for maximizing the volume of the car 1 when the roof deck 4 is horizontal in said second position II, the roof deck 4 is horizontal in said first position I. When horizontal, a planar upper face of the roof deck 4 is horizontal and/or a planar lower face of the roof deck 4 is horizontal. Said planar upper face f of the roof deck 4 which is horizontal preferably forms the upper face of the aforementioned working platform on top of which a person can stand outside the elevator car 1, in particular when the roof deck 4 is in said first position I. The area of the horizontal upper face f of the roof deck 4 is preferably at least 0.5 m2, preferably more, such as at least 1 m2.

When the roof deck 4 is in said second position the distance D2 between the upper face of the floor and the lower face of the roof deck 4 is preferably more than 2.5 meters. Preferably, when the roof deck 4 is in said second position the distance D2 between the upper face of the floor and the lower face of the roof deck 4 is less than 5 meters. It is likely that transportation of extremely high objects is rarely needed and since a very long vertical extension of the transport space 10 is difficult to simply and economically arrange, enlargement of the transport space to more than 5 meters is likely not needed, although this is possible.

Figure 17:
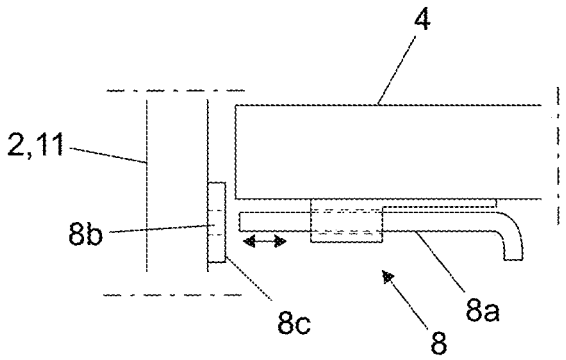
FIG. 17 illustrates preferred further details of the car and the elevator.

Preferably, although not necessarily, the elevator car 1 comprises a locking equipment 8 operable to lock the roof deck 4 immovably in said position II. Thus, the roof deck 4 stays stationary when in said position II, which is advantageous in terms of safety and the roof deck 4 need not rest supported by other means, such as by the long object to be transported for instance. FIGS. 1 and 2 illustrate said locking equipment 8 in broken line since presence of thereof is not necessary. FIG. 17 illustrates preferred details of the locking equipment 8. In this case, the locking equipment 8 comprises locking rod 8*a* movably mounted on the roof deck 4 and movable to and from a recess 8*b* which is immovable at least in vertical direction. The locking equipment could alternatively be of different construction. The recess 8*b* can be formed in a counterpart component 8*c* mounted immovably on a part 2,11 of the car 1, such as a wall 2 or railing 11 or car frame, for example. The car 1 preferably comprises a counterpart 8*c* as illustrated in FIG. 17 on a first vertical level in particular such that the recess 8*b* thereof is level with the locking rod 8*a* when the roof deck 4 is in said first position I and another counterpart 8*c* as illustrated in FIG. 17 on a second vertical level in particular such that the recess 8*b* thereof is level with the locking rod 8*a* when the roof deck 4 is in said second position II.

Figure 3:
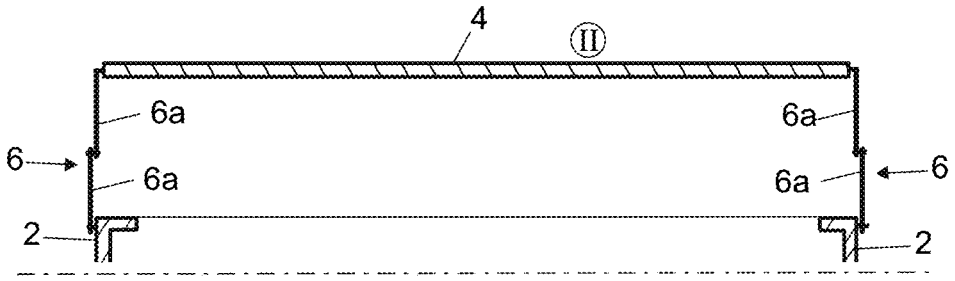
FIG. 3 illustrates a cross section of the roof deck of FIG. 1 and in its second position as viewed in front-to-back direction.
Figure 4:
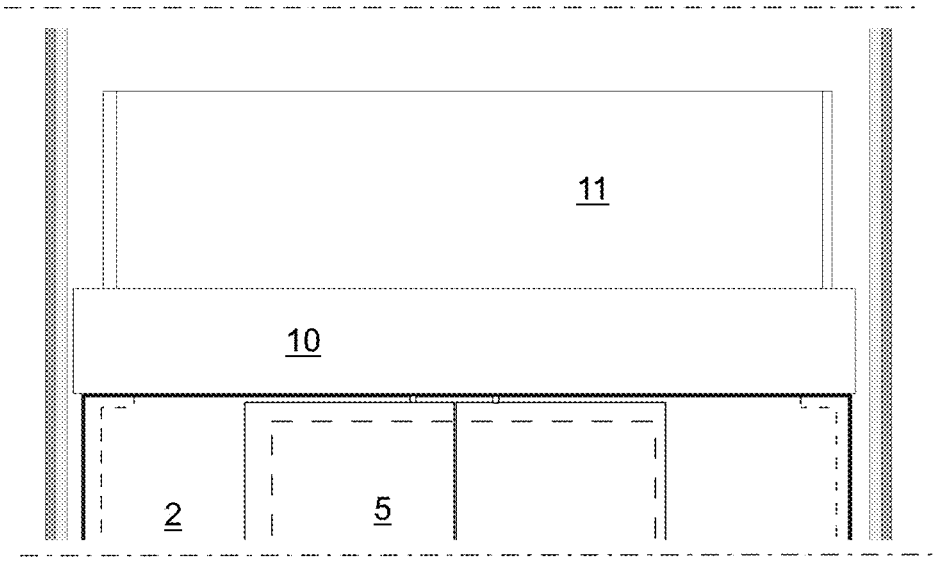
FIG. 4 illustrates partially the front view of the elevator car of FIGS. 1-3.

As illustrated in FIGS. 1-3, the elevator car 1 comprises one or more vertically extendable support mechanisms 6 by which the roof deck 4 is mounted on stationary structures 2 of the car 1 relative to which the roof deck 4 is movable, the stationary structures preferably being the car frame or car wall 2, for instance. In the embodiment illustrated in FIGS. 1-3, the elevator car 1 comprises plurality of said extendable support mechanisms 6. Hereby, plurality of support points can be provided and the roof deck 4 can be made stable. The plurality of said extendable support mechanisms 6 are arranged at horizontally displaced locations for facilitating stability of the roof deck 4 particularly in its second position II. In the embodiment illustrated in FIGS. 1-3, each said vertically extendable support mechanism 6 comprises one or more pivotal arms 6*a*,6*b*, in particular two, although each extendable support mechanism 6 could alternatively implemented with only one pivotal arm, e.g. when one end thereof is connected to the roof deck 4 and the other end to the stationary structures 2 of the car 1. Each said extendable support mechanisms 6 could also be implemented differently, such as without pivoting, such as a linearly extendable support mechanism. In this case, the extendable support mechanism could comprise for example a telescopically extendable support arm, or a vertically oriented support arm movable along a guide rail mounted on the stationary structures 2 of the car 1.

The aforementioned door 5 is suitable for allowing access to said transport space 10 from the side of the car 1. The aforementioned door 5 is preferably an automatic door openable and closable by a door operator 10 comprised in the car 1.

Figure 5:
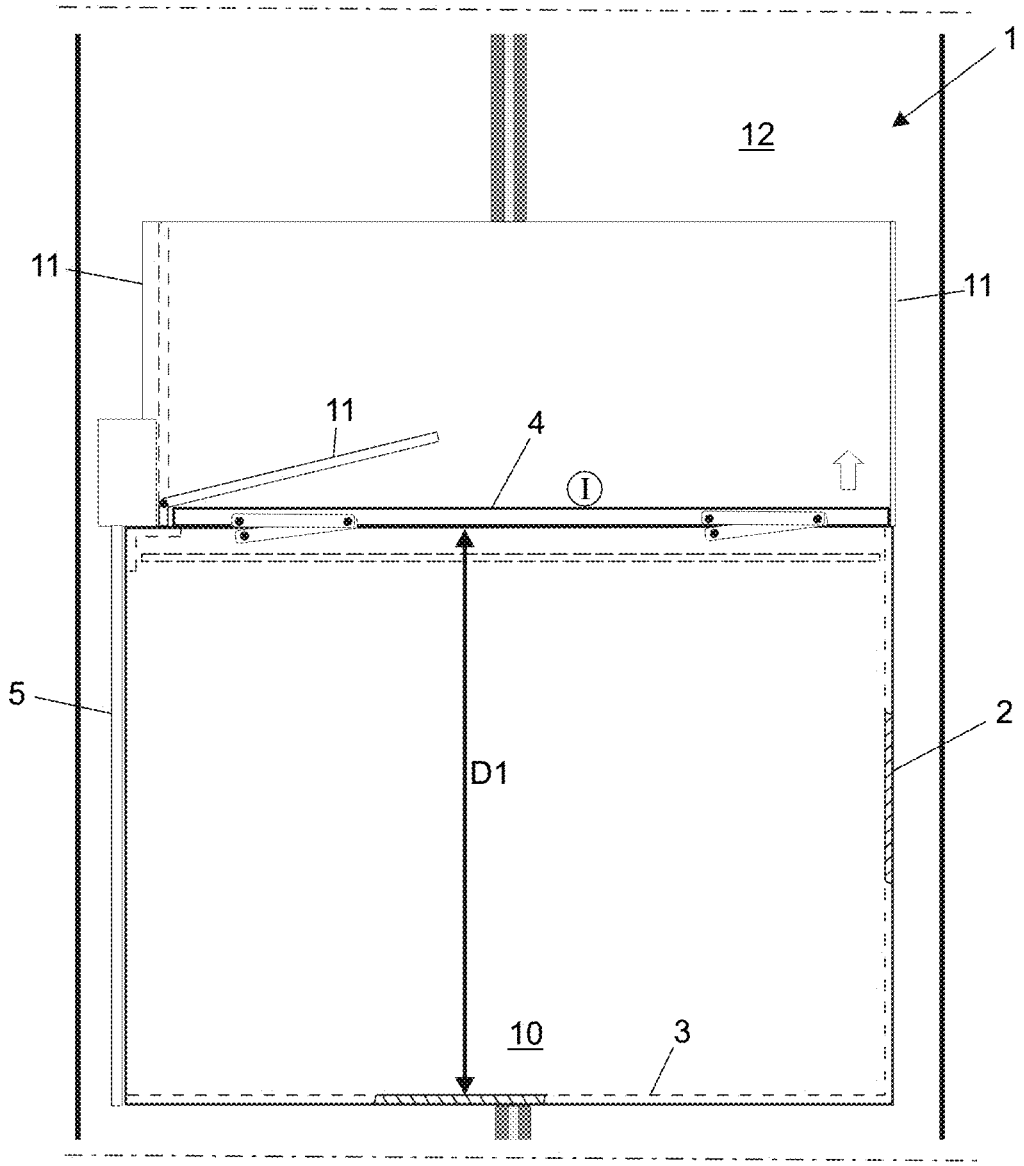
FIG. 5 illustrates optional further details of the elevator car of FIG. 1 as viewed from a side.

The elevator car 1 preferably also comprises railings mounted on top of the car 1, in particular railings 11 between which a person can stand. This is in the preferred embodiment implemented such that the railings 11 surround the vertical projection of the roof deck 4, whereby the roof deck 4 is vertically movable within a space W between the railings 11. The railings 11 form walls surrounding laterally a space W, which is preferably working space W in particular for accommodating at least a lower body of a person. In FIGS. 1 and 2, a railing 11 blocking view of the roof deck 4 has not been showed. The railings 11 can comprise one or more portions, which are pivotal between a vertical orientation and an inclined orientation, as illustrated in FIG. 5. This may facilitate vertical compactness of the car 1 during normal operation and/or accessibility to the working space W.

Figure 6:
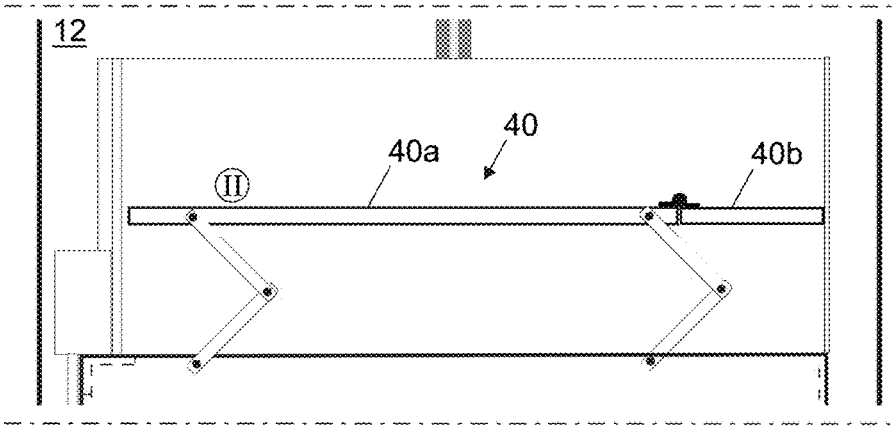
FIG. 6 illustrates optional further details of the elevator car of FIG. 1 as viewed from a side.
Figure 7:
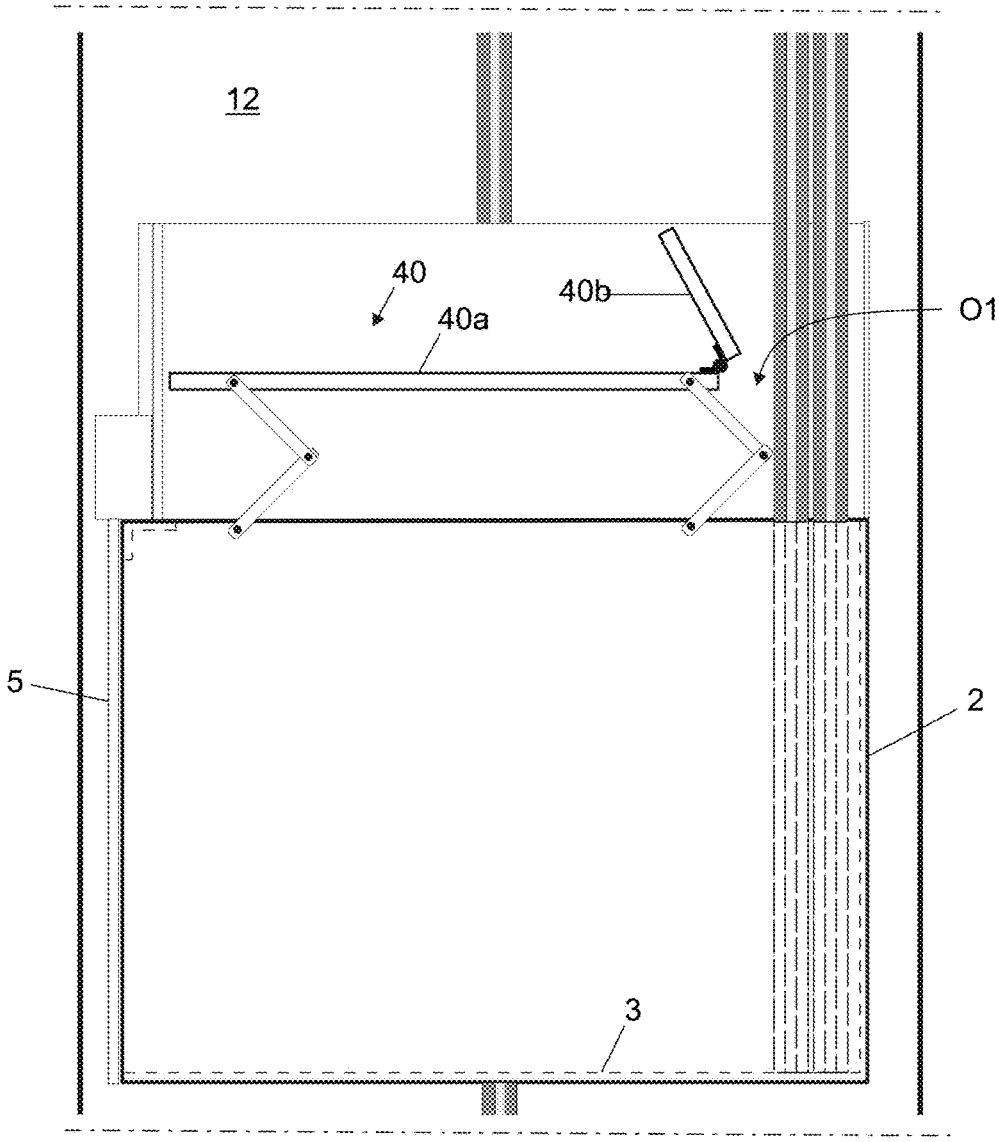
FIG. 7 illustrates the elevator car of FIG. 6 as viewed from a side when loaded with a large object.

FIGS. 6-7 illustrate an embodiment, where the roof deck 40 comprises a portion 40*b* displaceable for forming an opening O1 in the roof deck 40. The roof deck 40 is otherwise as the roof deck 4 described elsewhere. The portion 40*b* is mounted by hinges to the main portion 40*a* of the roof deck 40. Said opening O1 provides that very tall objects can be transported by the car 1. In FIG. 7, guide rail sections have been placed to extend partially in the transport space 10 the upper end of them extending through the opening O1 to the hoistway side.

FIGS. 8-11 illustrate an embodiment, where the roof deck 400 comprises a roof deck portion 400*b*1 displaceable for forming an opening O2 in the roof deck 400. The roof deck 400 is otherwise as the roof deck 4 described elsewhere. The portion 400*b*1 is mounted by hinges to the main portion 400*a* of the roof deck 400. Said opening O2 provides that very tall objects can be transported by the car 1. In this embodiment, the roof deck 400 moreover comprises a roof deck portion 400*b*2 mounted by hinges to the roof deck portion 400*b*1 of the roof deck 400. Thus, should only a small opening be needed, by opening only the roof deck portion 400*b*2, a smaller opening could be formed in the roof deck 400.

Figure 8:
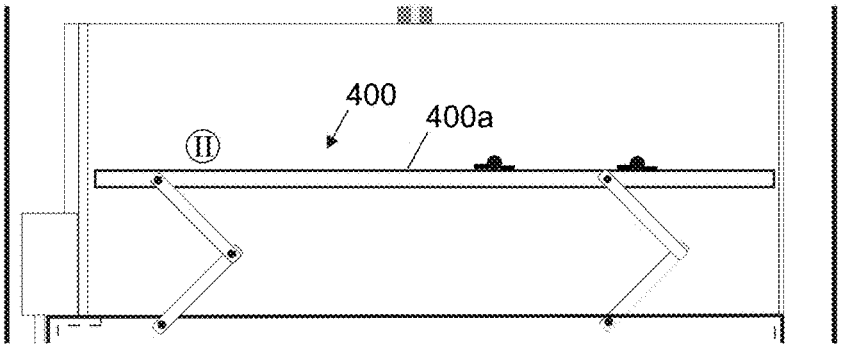
FIG. 8 illustrates optional further details of the elevator car of FIG. 1 as viewed from a side.
Figure 9:
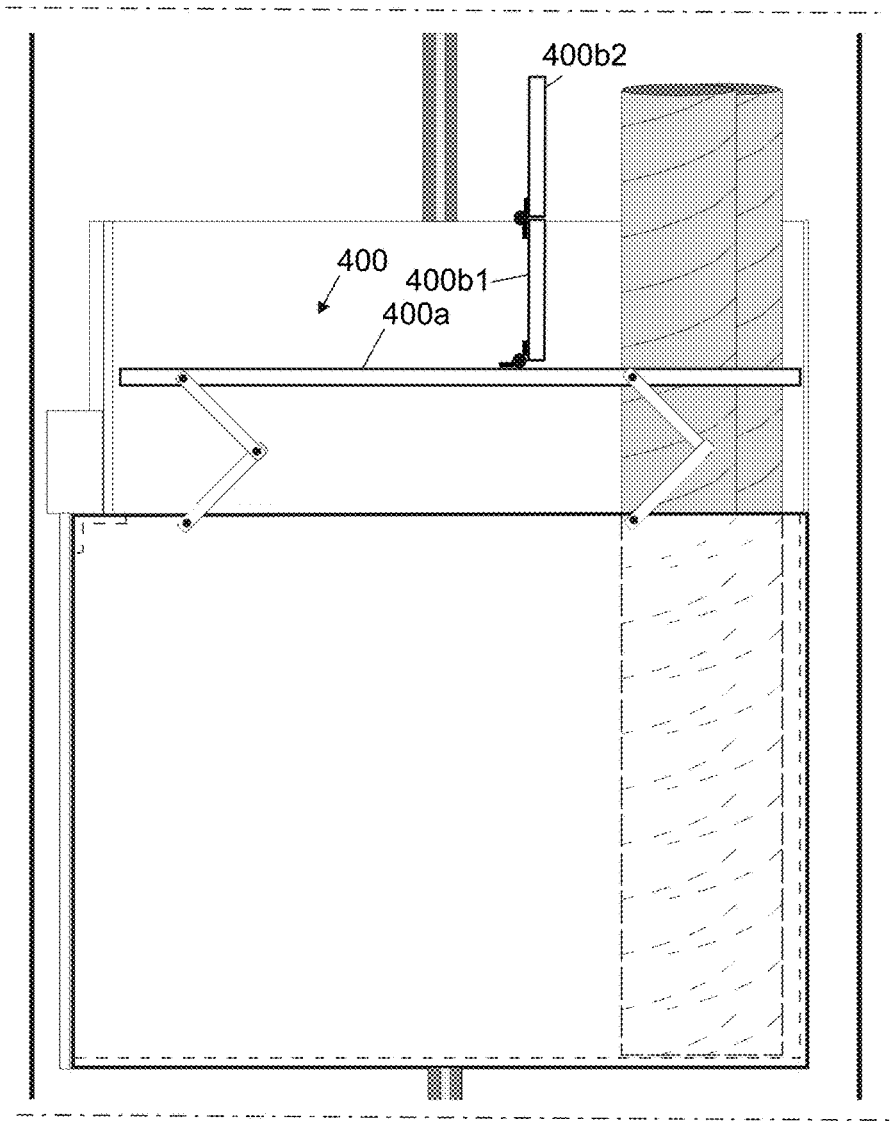
FIG. 9 illustrates the elevator car of FIG. 8 as viewed from a side when loaded with large goods.
Figure 10:
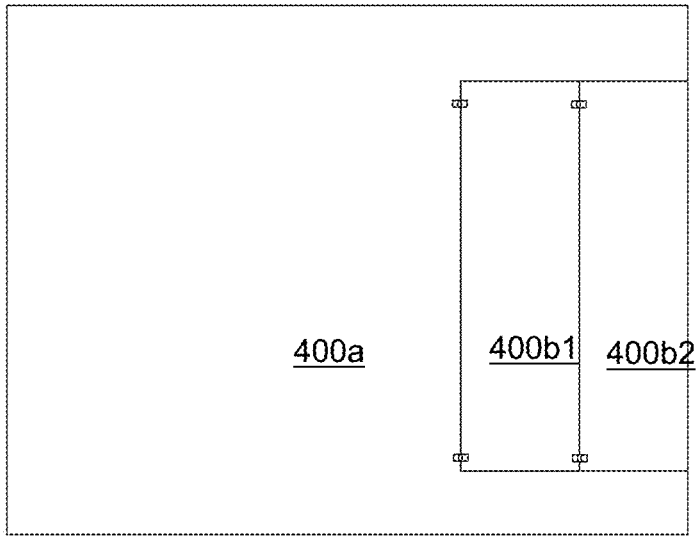
FIG. 10 illustrates the roof deck car of FIG. 8 as viewed from above.
Figure 11:
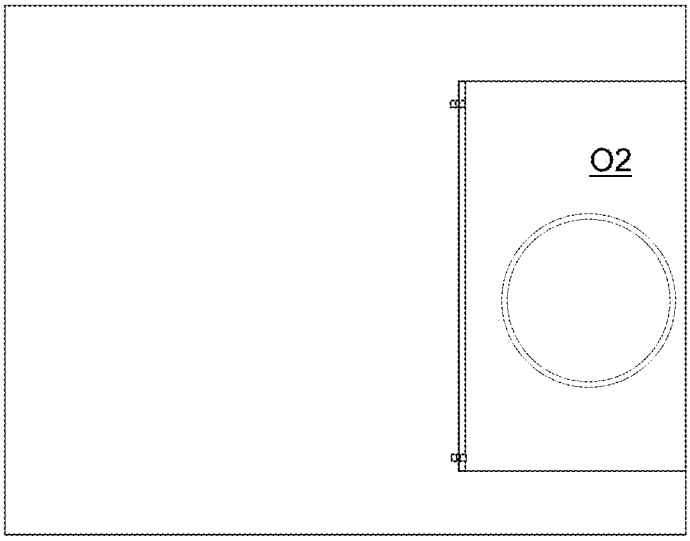
FIG. 11 illustrates the roof deck car of FIG. 9 as viewed from above.

FIGS. 10 and 11 illustrate the roof deck 400 of FIGS. 8 and 9 from above. In FIGS. 9 and 11, a ventilation tube section has been placed to extend partially in the transport space 10 the upper end of the tube extending through the opening O2 to the hoistway side.

Figure 12:
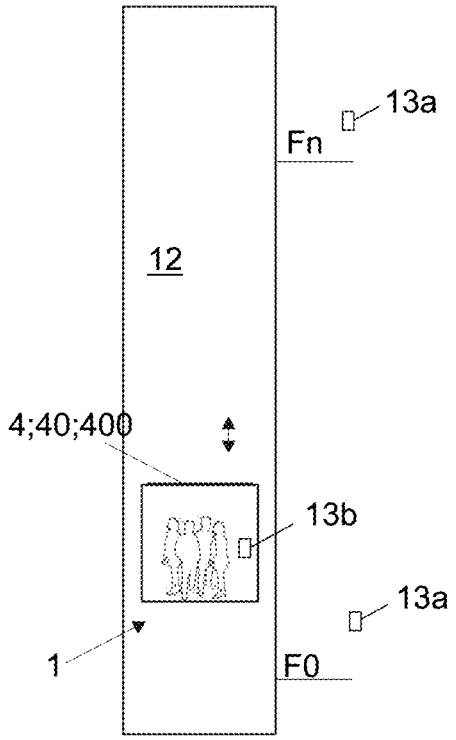
FIG. 12 illustrates an elevator where the car in use for transporting passengers.
Figure 13:
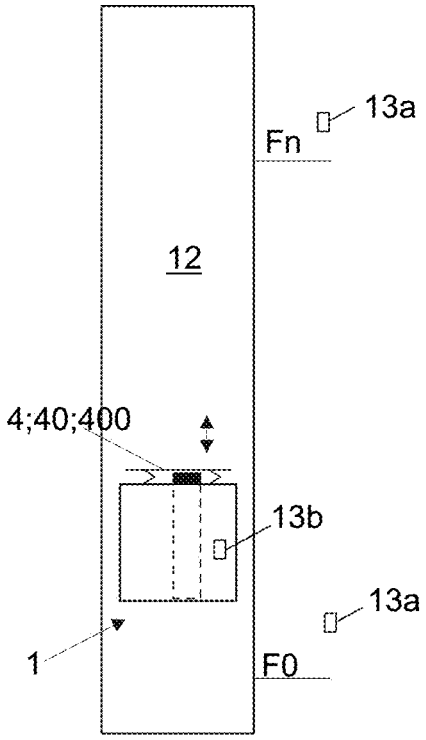
FIG. 13 illustrates an elevator where the car in use for transporting large goods.

FIGS. 12 and 13 illustrate and elevator comprising a car 1 as described referring to FIGS. 1-11. The railings 11 have not been showed for the sake of clarity. The car 1 is vertically movable in a hoistway 12. In FIG. 12, the roof deck 4;40;400 of the car 1 is in the first position I and the car 1 is in use for transporting passengers. In FIG. 13, the roof deck 4;40;400 of the car 1 is in the second position II and the car 1 is in use for transporting large goods.

The hoistway 12 is preferably inside a building whereby this part of the elevator can be a permanent part of the building.

Figure 14:
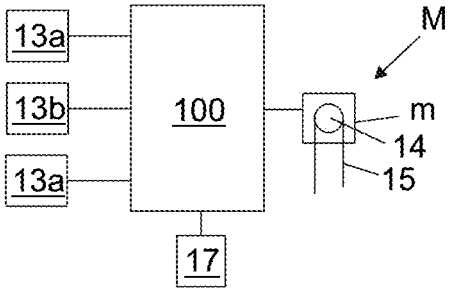
FIG. 14 illustrates preferred further details of the elevator.

The elevator comprises a hoisting machine M for moving the car 1 vertically in the hoistway 12, and an elevator control system 100 configured to control the hoisting machine M. Generally, the hoisting machine can be of any known kind. In FIG. 14 it is schematically drawn, as an example, to comprise a motor m and a traction sheave 14 arranged to move a roping 15, in which case the roping is preferably a suspension roping connected to the car 1.

The elevator control system 100 is configured, in particular by operating the hoisting machine M, to automatically move the elevator car 1 between vertically displaced landings in response to signals received from one or more one or more user interfaces 13.

Preferably, the aforementioned suspension roping is connected with the car 1 preferably at suspension point(s) preferably chosen so that they are apart from the roof deck 4,40,400. There are numerous known alternatives for this, such as frame beams or diverting wheels which may guide the ropes advantageously, e.g. to pass below the car. Generally, the hoisting arrangement can comprise a counterweight or be counterweightless. The elevator could have a machine room for the hoisting machine or be machine-roomless. The hoisting machine could alternatively be mounted on the car 1 such that the car is of a self propelled kind, in which case no roping is necessary.

Figure 16:
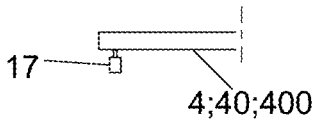
FIG. 16 illustrates preferred further details of the car and the elevator.

The car 1 preferably, although not necessarily, comprises one or more detectors 17, such as electronic switches, arranged to detect the position of the roof deck 4;40;400. This facilitates safety of the elevator. Preferred details of positioning and operation of said one or more detectors 17 are illustrated in FIGS. 14 and 16. The elevator control system 100 is configured to control movement of the elevator car 1 based on position of the roof deck 4;40;400 detected by said one or more detectors.

The control system 100 is preferably configured to prevent at least part of its functions of the elevator when one or more detectors indicate that the roof deck 4;40;400 is away from its first position I. The prevented functions preferably comprise automatically moving the car 1 in response to signals from one or more user interfaces, which are at one or more landings. Thus, passenger are not normally served when the roof deck 4;40;400 is in cargo position II. Said one or more detectors 17 can be detectors that are part of a safety chain, but this is not necessary.

Figure 15:
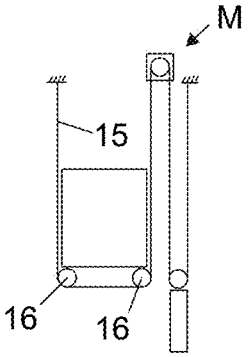
FIG. 15 illustrates preferred further details of the elevator.

FIG. 15 illustrates one preferred way to suspend the elevator car 1. In this embodiment, the elevator car 1 comprises a diverting wheel arrangement 16-17 for guiding a suspension roping 15, said diverting wheel arrangement 16;17 being separate from the roof deck 4;40;400. In this embodiment, said diverting wheel arrangement 16;17 comprises diverting wheels 16,17 for suspending the elevator car 1 from below. In this embodiment, said diverting wheels 16,17 are mounted lower than the transport space 10 and positioned to guide the suspension roping 15 to pass below the floor 3 across the vertical projection thereof. Thus, the suspension roping 15 can suspend the car 1 while allowing unobstructed movement of the roof deck 4;40;400 and working on top of it.

In an embodiment of a method for transporting passengers and goods, the method comprises transporting passengers with an elevator car 1 as described anywhere referring to FIGS. 1-11 while the roof deck 4;40;400 is in said first position I. This is illustrated in FIG. 12. Thereafter, the method comprises moving the roof deck 4;40;400 from said first position I to the second position II for thereby increasing the height of the transport space 10 of the elevator car 1. Thereafter, the method comprise transporting goods with the elevator car 1 while the roof deck 4;40;400 is in said second position II. This is illustrated in FIG. 13.

Preferably, the method comprises after said transporting goods with the elevator car 1 while the roof deck 4;40;400 is in said second position II, moving the roof deck 4;40;400 from said second position II back to the first position I, in particular for thereby reducing the height of the transport space 10.

Preferably, the method comprises between said moving roof deck 4;40;400 from said first position I to an second position II and subsequent transporting, locking a the roof deck 4;40;400 immovably in the position I,II, in particular by operating a locking equipment 8.

Preferably, each said transporting passengers with the elevator car 1 comprises receiving by an elevator control system 100 signals from one or more user interfaces 13*a*,13*b* and automatically moving the car 1 in response to said signals. Said user interfaces 13*a*,13*b* preferably comprise one or more user interfaces 13*a* at one or more landings f0,fn, a user interface 13*b* inside the elevator car 1 or mobile device comprising a user interface software communicating with the elevator control system 100.

In said transporting passengers, the passenger(s) is/are in the transport space 10 of the car 1, in particular below the roof deck 4;40;400. In said transporting goods, the goods is/are in the transport space (10) of the car 1, in particular below the roof deck 4;40;400.

As mentioned, the car 1 preferably, although not necessarily, comprises one or more detectors 17, such as electronic switches, arranged to detect the position of the roof deck 4;40;400. Then preferably, the method comprises controlling control movement of the elevator car 1 based on detection of the position of the roof deck 4;40;400 detected by one or more detectors. Then preferably, the method comprises, preferably by a control system 100, preventing at least part of functions of the elevator when one or more detectors indicate that the roof deck is away from its first position I. Preferably, said prevented functions comprise automatically moving the car 1 in response to signals from one or more user interfaces, which are at one or more landings. Thus, passenger are not normally served when the roof deck 4;40;400 is in cargo position II or incompletely brought to its normal use position I.

The transport space 10 is, in general, a space suitable for accommodating passengers. It is the uppermost transport space 10 of the car 1, in particular irrespective of the number of transport spaces the car 1 has. Preferably, the car 1 comprises only on transport space 10, although the invention can be utilized also when the car has more than one or more transport spaces below the transport space 10 bordered by the roof deck 4;40;400. The roof deck 4;40;400, in general, preferably forms either completely or at least partially the roof of the car 1.

Generally, most preferably, the roof deck 4;40;400 is such large that the vertical projection thereof covers majority, i.e. more than 50%, of the vertical projection of the transport space 10, most preferably however more than 75% of the vertical projection of the transport space 10. Thereby, the area of the roof deck 4;40;400 is large such that rising thereof produces an enlargement of a substantially vast area so that vast and tall goods can be transported in the transport space 10 when enlarged. Accordingly, amount of enlargement of the transport space 10 can be maximized as measured in volume. Moreover, thereby the area of the roof deck 4;40;400 is large such that it can serve as a relatively large working platform.

Generally preferably, the car 1 comprises one or more detectors, such as electronic switches, arranged to detect the position of the roof deck 4;40;400.

As illustrated in Figures, it is preferable that the elevator car 1 of the elevator is arranged to travel along at least one guide rail G mounted in a hoistway 12. For this purpose, the car 1 preferably comprises at least one guide (not showed), such as roller guide or sliding guide, for guiding the movement of the car along said at least one rail G.

Figure 18:
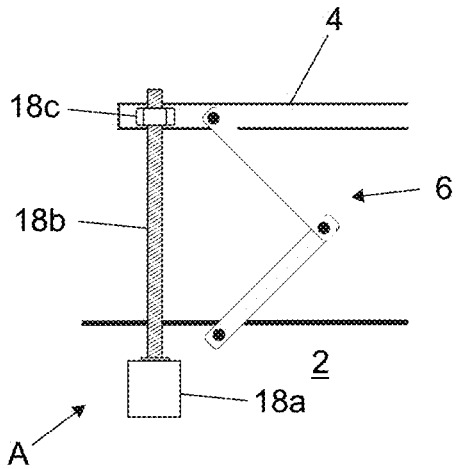
FIG. 18 illustrates preferred details of the car and the elevator.

FIG. 18 illustrates preferred further details of the elevator car 1 of FIG. 1. In this case, the elevator car 1 comprises at least one actuating arrangement A for moving the roof deck 4;40;400 vertically from said first position I upwards to said second position II and/or from said second position II downwards to said first position I. The actuating arrangement A comprises at least one actuator 18*a*. The actuator 18*a* is preferably an electric motor as it is the case in the embodiment of FIG. 18. The actuator could alternatively be different, for example a hydraulic or pneumatic actuator, for example. In the embodiment of FIG. 18, the actuating arrangement A is a screw jack. In particular, in the embodiment of FIG. 18, the actuator 18*a* is mounted stationary on the car 1, such as on the frame or the wall 2 thereof, for example. In the embodiment of FIG. 18, the actuating arrangement A comprises a screw 18*b* rotatable by the actuator 18*a* and a counterpart 8*c* for the screw 8*b*, in particular a nut meshing with the screw 8*b*, which counterpart 8*c* is mounted on the roof deck 4. In FIG. 18, the elevator car 1 comprises the actuating arrangement in addition to the vertically extendable support mechanisms 6. However, alternatively in the embodiment of FIG. 18, the actuating arrangement (s) A could form the vertically extendable support mechanism(s) of the car 1. Then, the pivotal arms illustrated can be omitted. Then, the elevator car comprises one or more vertically extendable support mechanisms, each formed by an actuating arrangement A, by which the roof deck is mounted stationary structures of the car in particular relative to which the roof deck is movable, the stationary structures preferably being the car frame or car wall, for instance. Also in this case, preferably, the elevator car comprises plurality of said vertically extendable support mechanisms. Also in this case, the plurality of said vertically extendable support mechanisms are arranged at horizontally displaced locations. Generally, the vertically extendable means that the mechanism comprises two parts the vertical distance of which can be extended to different lengths.

It is to be understood that the above description and the accompanying Figures are only intended to teach the best way known to the inventors to make and use the invention. It will be apparent to a person skilled in the art that the inventive concept can be implemented in various ways. The above-described embodiments of the invention may thus be modified or varied, without departing from the invention, as appreciated by those skilled in the art in light of the above teachings. It is therefore to be understood that the invention and its embodiments are not limited to the examples described above but may vary within the scope of the claims.

The invention claimed is:

1. An elevator car comprising:

a roof deck;

a plurality of walls;

a floor;

one or more doors;

supports attaching the roof deck to the plurality of walls, the supports being attached to opposed walls of the plurality of walls; and a transport space bordered by said roof deck, said plurality of walls, said floor, and said one or more doors, wherein the roof deck is vertically movable from a first position upwards to a second position for increasing a height of the transport space, and from said second position downwards back to said first position, and wherein the roof deck has a first section hingedly attached to a remainder of the roof deck.

2. The elevator car according to claim 1, wherein the elevator car comprises a displaceably mounted panel below the roof deck.

3. The elevator car according to claim 1, wherein the elevator car comprises railings mounted on top of the car.

4. The elevator car according to claim 3, wherein the roof deck is vertically movable within a space between the railings.

5. The elevator car according to claim 3, wherein the railings are foldable to be on top of the roof deck.

6. The elevator car according to claim 1, wherein when the roof deck is in said first position, a vertical distance (D1) between an upper face of the floor and a lower face of the roof deck is more than 1.8 meters, and when the roof deck is in said second position, a vertical distance (D2) between the upper face of the floor and the lower face of the roof deck is a distance Dd longer.

7. The elevator car according to claim 1, wherein when the roof deck is in said second position, a free distance (D2) between an upper face of the floor and a lower face of the roof deck is more than 2.5 meters.

8. The elevator car according to claim 1, wherein the roof deck is horizontal in said second position.

9. The elevator car according to claim 1, wherein the elevator car comprises locking equipment operable to lock the roof deck immovably in said second position.

10. The elevator car according to claim 1, wherein the elevator car comprises one or more vertically extendable support mechanism by which the roof deck is mounted to stationary structures of the car.

11. The elevator car according to claim 1, wherein the elevator car comprises a diverting wheel arrangement for guiding a suspension roping, said diverting wheel arrangement being separate from the roof deck.

12. The elevator car according to claim 1, wherein the elevator car comprises one or more detectors arranged to detect the position of the roof deck.

13. An elevator comprising the elevator car according to claim 1.

14. A method for transporting passengers and goods, comprising the steps of:

transporting passengers with the elevator car according to claim 1 while the roof deck is in said first position; and thereafter moving the roof deck from said first position to the second position for thereby increasing the height of the transport space of the elevator car; and thereafter transporting goods with the elevator car while the roof deck is in said second position.

15. The method according to claim 14, wherein each said transporting passengers with the elevator car comprises receiving by an elevator control system signals from one or more user interfaces and automatically moving the car in response to said signals, said user interfaces comprising one or more user interfaces at one or more landings, a user interface inside the elevator car or a mobile device comprising a user interface software communicating with the elevator control system.

16. The method according to claim 14, wherein the method comprises controlling movement of the elevator car based on a position of the roof deck detected by one or more detectors.

17. The elevator car according to claim 1, wherein the elevator car comprises a displaceably mounted panel below the roof deck and covering a lower face of the roof deck.

18. The elevator car according to claim 1, wherein the roof deck forms a working platform on top of which a person can stand outside the elevator car at least when the roof deck is in said first position.

19. The elevator car according to claim 1, wherein the elevator car comprises railings mounted on top of the car between which a person can stand outside the car.

20. The elevator car according to claim 1, wherein the roof deck has a second section hingedly connected to the first section.

* * * * *